US008100746B2

(12) United States Patent
Heidel et al.

(10) Patent No.: US 8,100,746 B2
(45) Date of Patent: Jan. 24, 2012

(54) INDOOR AIR QUALITY SYSTEMS AND METHODS

(75) Inventors: Thomas Heidel, Neosho, WI (US); Luis Wasserman, Mequon, WI (US)

(73) Assignee: Broan-NuTone LLC, Hartford, WI (US)

( * ) Notice: Subject to any disclaimer, the term of this patent is extended or adjusted under 35 U.S.C. 154(b) by 1695 days.

(21) Appl. No.: 11/325,129

(22) Filed: Jan. 4, 2006

(65) Prior Publication Data

US 2007/0155305 A1 Jul. 5, 2007

(51) Int. Cl.
*F24F 7/06* (2006.01)

(52) U.S. Cl. ..... 454/356

(58) Field of Classification Search ..... 454/356
See application file for complete search history.

(56) References Cited

U.S. PATENT DOCUMENTS

| | | | |
|---|---|---|---|
| 4,372,195 | A | 2/1983 | Dorius |
| 4,437,608 | A | 3/1984 | Smith |
| 4,483,316 | A | 11/1984 | Fritz et al. |
| 4,484,563 | A | 11/1984 | Fritz et al. |
| 4,489,881 | A | 12/1984 | Dean et al. |
| 4,497,242 | A | 2/1985 | Moyer |
| 4,773,311 | A | 9/1988 | Sharp |
| 4,776,385 | A | 10/1988 | Dean |
| 4,836,096 | A | 6/1989 | Avery |
| 4,903,685 | A | 2/1990 | Melink |
| 5,039,006 | A | 8/1991 | Habegger |
| 5,131,887 | A | 7/1992 | Traudt |
| 5,282,770 | A | 2/1994 | Shibata |
| 5,290,200 | A | 3/1994 | Kiser |
| 5,333,783 | A | 8/1994 | Catan |
| 5,385,505 | A | 1/1995 | Sharp et al. |
| 5,438,324 | A | 8/1995 | Chyi et al. |
| 5,520,328 | A | 5/1996 | Bujak, Jr. |
| 5,545,086 | A | 8/1996 | Sharp et al. |
| 5,547,017 | A | 8/1996 | Rudd |
| 5,720,658 | A | 2/1998 | Belusa |
| 5,771,879 | A | 6/1998 | Saltzman |

(Continued)

FOREIGN PATENT DOCUMENTS

JP 10038346 A * 2/1998

OTHER PUBLICATIONS

Abstract translation of JP10038346A.*

(Continued)

*Primary Examiner* — Steven B McAllister
*Assistant Examiner* — Helena Kosanovic
(74) *Attorney, Agent, or Firm* — Greenberg Traurig, LLP

(57) ABSTRACT

An indoor air quality system and method for a building. In an embodiment, the system includes a plurality of exhaust fans and a plurality of controllers. The exhaust fans each have a predetermined exhaust rate. The controllers are configured to monitor an actual volume of air exhausted by the indoor air quality system, and to automatically operate the exhaust fans to exhaust a desired volume of air during a time period. In an embodiment, the method includes setting parameters in a plurality of controllers, communicating to the controllers an operating state of the fans, determining a time at which to energize the fans such that the volume of air to exchange during the time period is exchanged during the time period, and energizing the fans at the determined time.

5 Claims, 11 Drawing Sheets

U.S. PATENT DOCUMENTS

| | | | |
|---|---|---|---|
| 5,791,983 | A | 8/1998 | Robertson |
| 5,846,128 | A | 12/1998 | Kramer |
| 5,881,806 | A | 3/1999 | Rudd |
| 6,119,680 | A | 9/2000 | Barritt |
| 6,283,851 | B1 | 9/2001 | Smith et al. |
| 6,328,095 | B1 | 12/2001 | Felber et al. |
| 6,431,268 | B1 | 8/2002 | Rudd |
| 6,540,603 | B1 | 4/2003 | Koskinen |
| 6,726,111 | B2 | 4/2004 | Weimer et al. |
| 6,774,802 | B2 | 8/2004 | Bachinski et al. |
| 6,848,623 | B2 | 2/2005 | Weimer et al. |
| 2002/0183001 | A1 | 12/2002 | Holter et al. |
| 2003/0050737 | A1 | 3/2003 | Osann, Jr. |
| 2004/0185770 | A1 | 9/2004 | Soeholm et al. |

OTHER PUBLICATIONS

American Society of Heating, Refrigerating and Air-Conditioning Engineers, Inc.; ANSI/ASHRAE Standard 62.2-2004 Ventilation and Acceptable Indoor Air Quality in Low-Rise Residential Buildings; ASHRAE Standard; Nov. 2004; pp. 1-24.

* cited by examiner

INDOOR AIR QUALITY SYSTEMS AND METHODS

FIELD

The invention relates generally to indoor air quality and specifically to ventilation systems to achieve certain air changes per hour for residential and commercial buildings.

BACKGROUND

As technology and building practices have evolved to build structures that are more airtight, the need for adequately ventilating these structures has increased. Without proper ventilation, pollutants and moisture trapped in a building can create an unhealthy living environment.

SUMMARY

In one embodiment, the invention provides an indoor air quality system for a building. The system includes a plurality of exhaust fans and a plurality of controllers. The exhaust fans each have a predetermined exhaust rate. The controllers are configured to monitor an actual volume of air exhausted by the indoor air quality system, and to automatically operate the exhaust fans to exhaust a desired volume of air during a time period.

In another embodiment, the invention provides a method of exchanging air in a building. The method comprises establishing a volume of air to be exhausted from the building in a time period, tracking a volume of air actually exhausted, calculating a remaining volume of air to be exhausted in the time period, determining a length of time needed to exhaust the remaining volume of air, and then exhausting the remaining volume of air during the time period.

In another embodiment, the invention provides a method of controlling an exchange of air in a building. The method includes setting parameters in a plurality of controllers, the parameters including an exhaust rate for a plurality of fans, a time period, and a volume of air to exchange during the time period. The method also includes communicating to the controllers an operating state of the fans and determining a time at which to energize the fans such that the volume of air to exchange during the time period is exchanged during the time period. Finally, the method includes energizing the fans at the determined time.

This summary does not set forth all embodiments and should not be construed as limiting of embodiments of the invention. In addition, other aspects of the invention will become apparent by consideration of the detailed description and accompanying drawings.

DETAILED DESCRIPTION

Figure 1A:
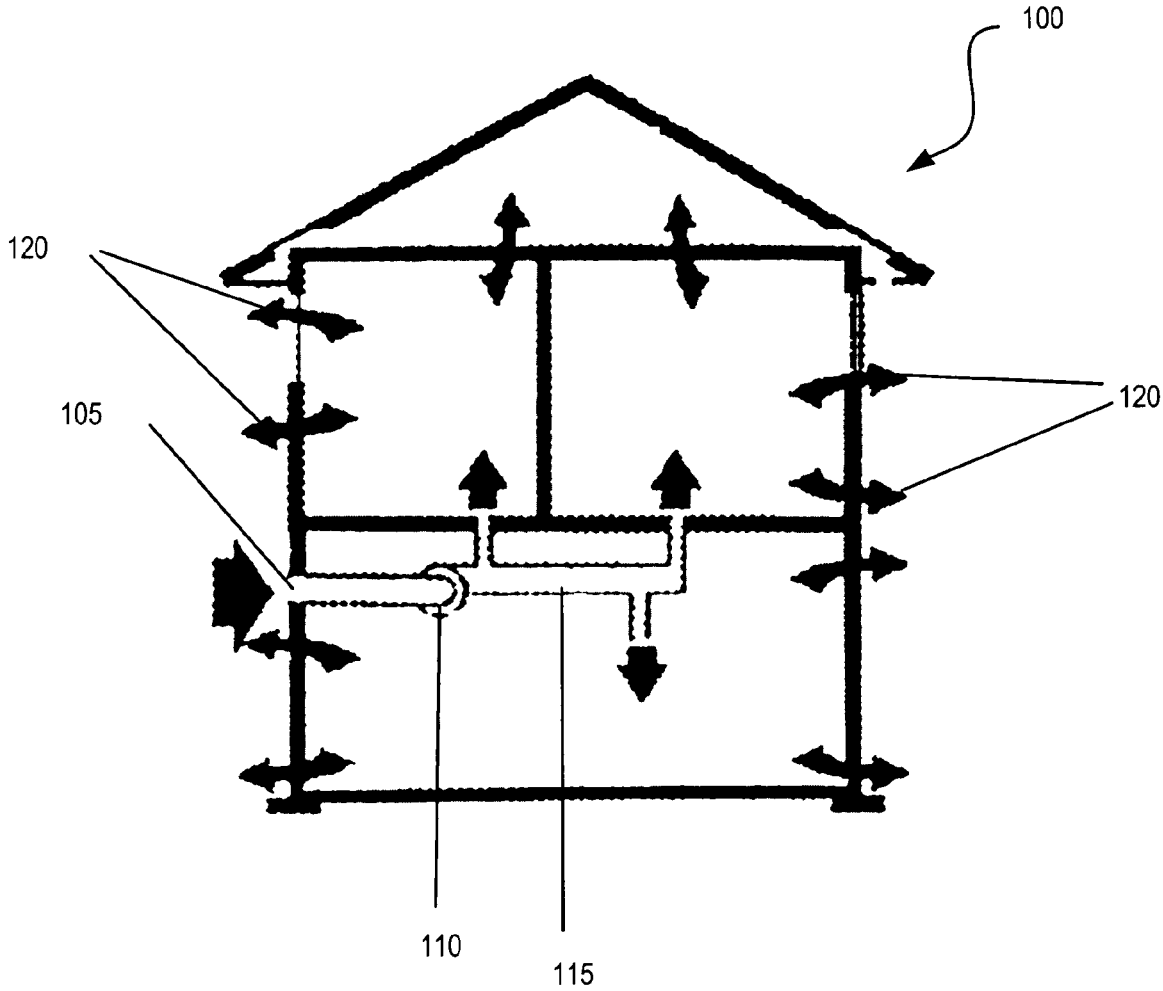
FIG. 1A is an illustration of a supply ventilation system for a building.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," and "coupled" and variations thereof are used broadly and encompass both direct and indirect mountings, connections, supports, and couplings. Further, "connected" and "coupled" are not restricted to physical or mechanical connections or couplings.

Newer airtight building practices effectively seal indoor air from outdoor air, affecting the quality of the indoor air. Thus, a need to address the ventilation and air-exchange needs of new buildings has arisen.

The American Society of Heating, Refrigerating, and Air-Conditioning Engineers, Inc. ("ASHRAE") has developed standards for ventilation systems. ASHRAE Standard 62.2-2004 provides guidelines for achieving acceptable indoor air quality in low-rise residential buildings, and defines a minimum ventilation rate for a residence based on the size of the residence and the number of people occupying the residence. To calculate the minimum ventilation rate for a residence, ASHRAE assumes that one person occupies the house for each bedroom in the house. ASHRAE also assumes that two people occupy the master bedroom. The formula ASHRAE uses in its standard to determine the desired rate of ventilation for a residence is:

$$V_{MOVE}=(0.01\times S)+(7.5\times(BR+1))$$

where:

$V_{MOVE}$ is the rate at which air is to be exchanged in cubic feet per minute ("CFM"), S is the size of the residence in square feet, and BR is the number of bedrooms in the residence.

For example, for a residence with 2,000 square feet ("$ft^2$") of living space and three bedrooms, the ventilation rate required by the standard is:

$$V_{MOVE}=(0.01\times 2{,}000)+(7.5\times(3+1)) \text{ or}$$

$$V_{MOVE}=50 \text{ CFM}$$

The ASHRAE standard does not require continuous ventilation (e.g., the 50 CFM of the example). Instead, the ASHRAE standard requires that the total volume of air exchanged over a period of time (the ASHRAE standard sets the time period at three hours) be equal to the volume of air that would have been exchanged had there been continuous ventilation at the calculated rate. For the residence in the example above, the amount of air that must be exchanged is calculated by taking the ventilation rate ($V_{MOVE}$) and multiplying it by the time period ($T_{PER}$). In this example, $V_{MOVE}$ has been calculated in cubic feet per minute. In order to normalize all of the variables, the time period is converted to minutes as well. Thus, the three hour time period becomes 180 minutes. Multiplied by $V_{MOVE}$, 50 CFM in the example, the volume of air that must be exchanged every three hours to meet the ASHRAE standard is:

$$V_{PER}=V_{MOVE}\times T_{PER}=50\text{ CFM}\times 180\text{ minutes}=9{,}000\text{ cubic feet ("CF")}$$

Therefore, to meet the ASHRAE standard, a three bedroom, 2,000 square foot residence must have a ventilation system capable of exchanging a minimum of 9,000 CF of outdoor air for indoor air every three hours.

Figure 1B:
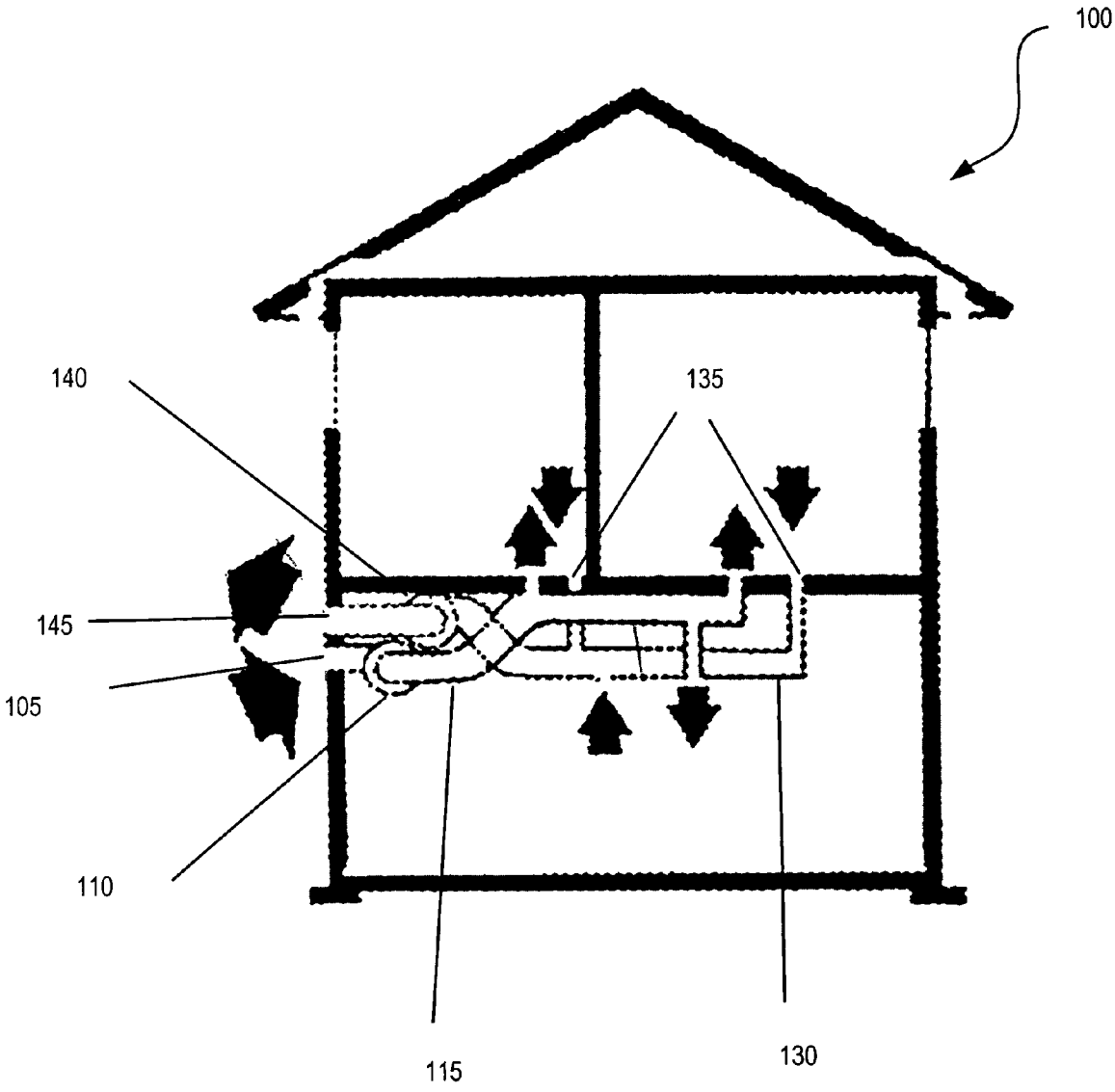
FIG. 1B is an illustration of a balanced ventilation system for a building.
Figure 1C:
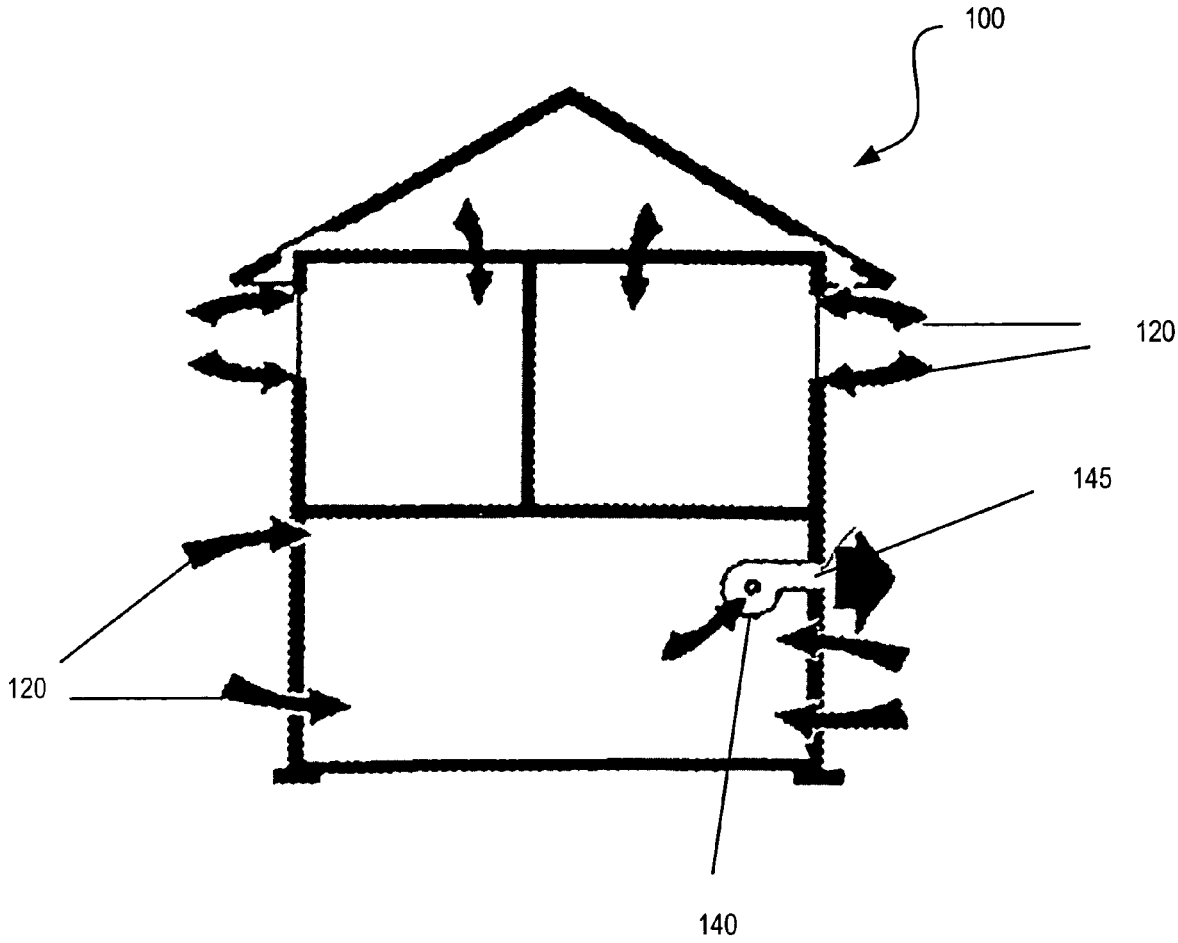
FIG. 1C is an illustration of an exhaust ventilation system for a building.

With today's airtight buildings, it is no longer possible to rely on passive ventilation systems to achieve a level of air exchange sufficient to meet the ASHRAE standard. An active ventilation system typically must be employed to ensure the level of air exchange necessary to maintain adequate indoor air quality ("IAQ"). FIGS. 1A, 1B, and 1C represent three types of ventilation systems available for exchanging the desired volume of outdoor air for indoor air to meet the ASHRAE standard.

FIG. 1A illustrates a supply ventilation system for ventilating a building 100 by forcing outdoor air into the building 100. Outdoor air is drawn through an opening 105 by a fan or blower 110. The outdoor air is then routed through ducting 115 in the building 100 to disperse the outdoor air throughout the building 100. The incoming outdoor air creates enough pressure in the building 100 to force existing indoor air out of the building 100 through leak points 120 that may exist in the building 100. These leak points 120 may exist in spite of efforts to make the building 100 airtight.

FIG. 1B illustrates a balanced ventilation system for ventilating a building 100. As in the supply ventilation system of FIG. 1A, outdoor air is drawn through an opening 105 by a fan or blower 110. The outdoor air is then routed through ducting 115 in the building 100 to disperse the outdoor air throughout the building 100. Instead of relying on leak points to remove the indoor air from the building 100, as in a supply ventilation system, the balanced ventilation system includes a second system of ducting 130 that can extend through the building 100 with openings 135 to receive the indoor air. The indoor air is drawn into the openings 135 by an exhaust fan or blower 140 and expelled outdoors through an exhaust opening 145. Blower 105 and exhaust blower 140 can be sized and operated such that the amount of outdoor air drawn in by the blower 105 is substantially equal to the amount of indoor air expelled by the exhaust blower 140.

FIG. 1C illustrates an exhaust ventilation system for ventilating a building 100. As in the balanced ventilation system of FIG. 1B, indoor air is expelled out an exhaust opening 145 by an exhaust fan or blower 140. Unlike the balanced ventilation system, the exhaust ventilation system does not include the supply portion of the balanced ventilation system (e.g., the opening 105 and the fan 110). In the exhaust ventilation system, the exhausting of indoor air creates a negative air pressure within the building 100 relative to the outdoor air pressure. The negative air pressure causes outdoor air to enter the building 100 through infiltration via leak points 120 as discussed with the supply ventilation system of FIG. 1A.

Each of the above types of ventilation systems—supply, balanced, and exhaust—can be used to achieve the volume of air exchange required by the ASHRAE standard or by other standards or design requirements. In trying to meet the ASHRAE standard, for example, home builders have generally used supply and balanced ventilation systems. Cost of equipment used in these systems can be relatively high. In addition, because of the design and installation of the ducting involved, professional heating ventilation and air conditioning ("HVAC") designers and installers must participate in the building process, adding cost to the overall system.

Embodiments of the invention relate to systems and methods for improving the quality of indoor air by exchanging a desired volume of relatively lower quality indoor air for an equivalent volume of relatively higher quality outdoor air over a selected time period. The volume of air to be exchanged and the time period are chosen based on several factors including the type of structure, the number of people occupying the structure, and environmental factors. The time periods repeat continuously with a new volume of air being exchanged each time period. Embodiments of the invention are illustrated using an exhaust ventilation scheme. It should be apparent, however, that the invention can be applied in supply and balanced ventilation schemes as well. In addition, some of the embodiments shown represent IAQ systems for meeting the ASHRAE standard for low rise residences. The invention, however, has application in many other structures, including office buildings, commercial buildings, and clean rooms. Further, although embodiments discussed herein refer to the ASHRAE standard, other embodiments of the invention do not pertain to that standard.

Embodiments of the invention use bathroom fans to exhaust indoor air from a building. The exhausted indoor air is replaced by outdoor air that infiltrates the building. In some embodiments of the invention, the fans are controlled by smart switches which monitor the operation of the fans in the building and ensure that a sufficient amount of air is exchanged to maintain the quality of the indoor air.

Embodiments of the invention relate to systems and methods of using an exhaust ventilation mode to achieve indoor air quality. The embodiments can use existing components in a building and be installed by non-HVAC professionals. The embodiments thus provide a means to achieve desired indoor air quality, in a building, without incurring significant cost in the construction of the building.

In some embodiments, existing bathroom or other exhaust fans, vented to the outdoors, are used to exhaust indoor air to the outside of a building. The bathroom fans function in place of the exhaust blower 140 of FIG. 1C. Cost savings are achieved as the fans can already be present in the bathrooms and therefore require no additional or incremental installation costs. Quiet fans (e.g., Model QTXE080SF, manufactured by Broan-NuTone LLC) can be used in the bathrooms. Since, in most residences, bathrooms are located near bedrooms, the use of quiet fans improves the appeal of the IAQ system because such fans will not awaken people when the fans energize during the nighttime. Other embodiments of the invention can use other means of exhausting indoor air (e.g., range hoods) either alone or in combination with bathroom fans.

Figure 2A:
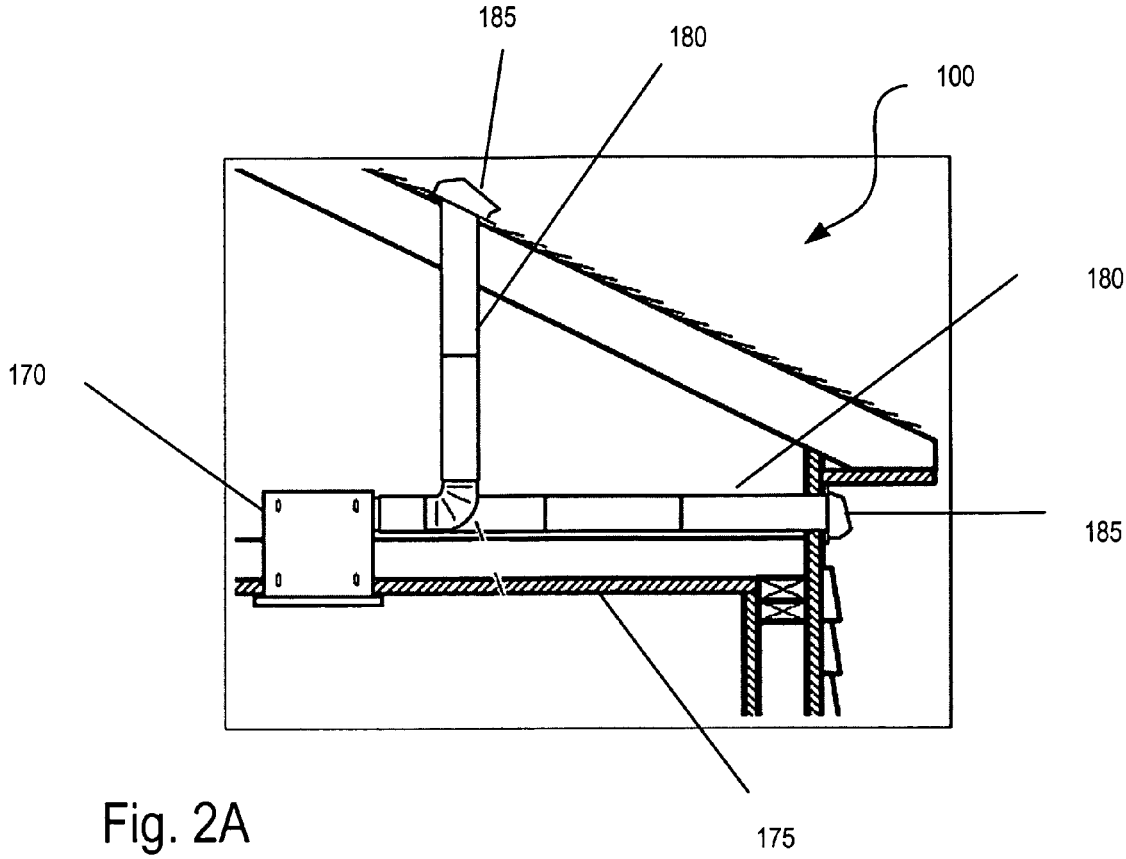
FIGS. 2A and 2B are illustrations of exemplary bathroom fan installations and associated ducting.
Figure 2B:
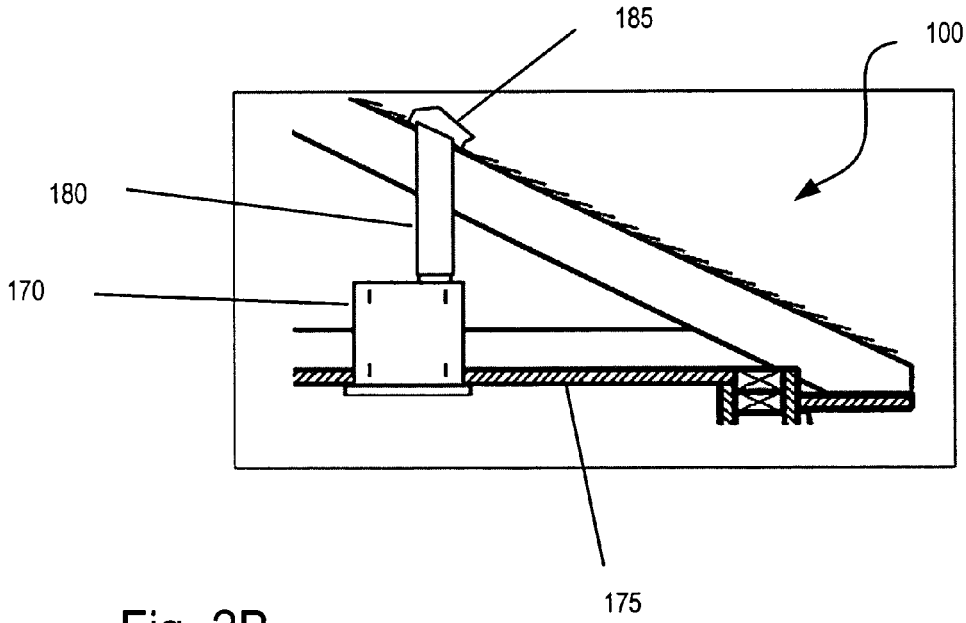

FIGS. 2A and 2B illustrate typical bathroom fan installations that can be employed in certain embodiments of the invention. A fan (not shown) is contained in a housing 170 which can be mounted flush with a bathroom ceiling 175. When the fan is energized, it draws air from the bathroom and forces this indoor air through a duct 180 and a cap 185 to the outside of a building 100. The rate at which a fan exhausts air is dependent on the size of an aperture in the housing 170; the size, orientation, and number of fan blades; the rate of rotation of the fan blades; and the size of the duct 180 venting the air to the outside of the building 100. For purposes of the embodiments discussed herein, it is assumed that all ducts 180 are properly sized and installed such that the capacity of each fan used throughout a building is not limited by its associated duct 180. Manufacturers of fans determine the rate at which their fans exhaust air and provide this exhaust rate, in CFM, with each fan. With appropriate ducting, a fan can be expected to exhaust air at approximately the exhaust rate provided by the manufacturer. Optional testing of the actual air flow of an installed fan under normal operating conditions can provide an accurate indication of the actual air flow and can verify that ducting is sized and installed properly.

In some embodiments, the duct 180 for a fan includes a damper. The damper can help to insulate the building from the outside air. The damper can be passive (air from the fan blows the damper open) or active (a controller can open the damper via a motor when the fan is energized).

Figure 3:
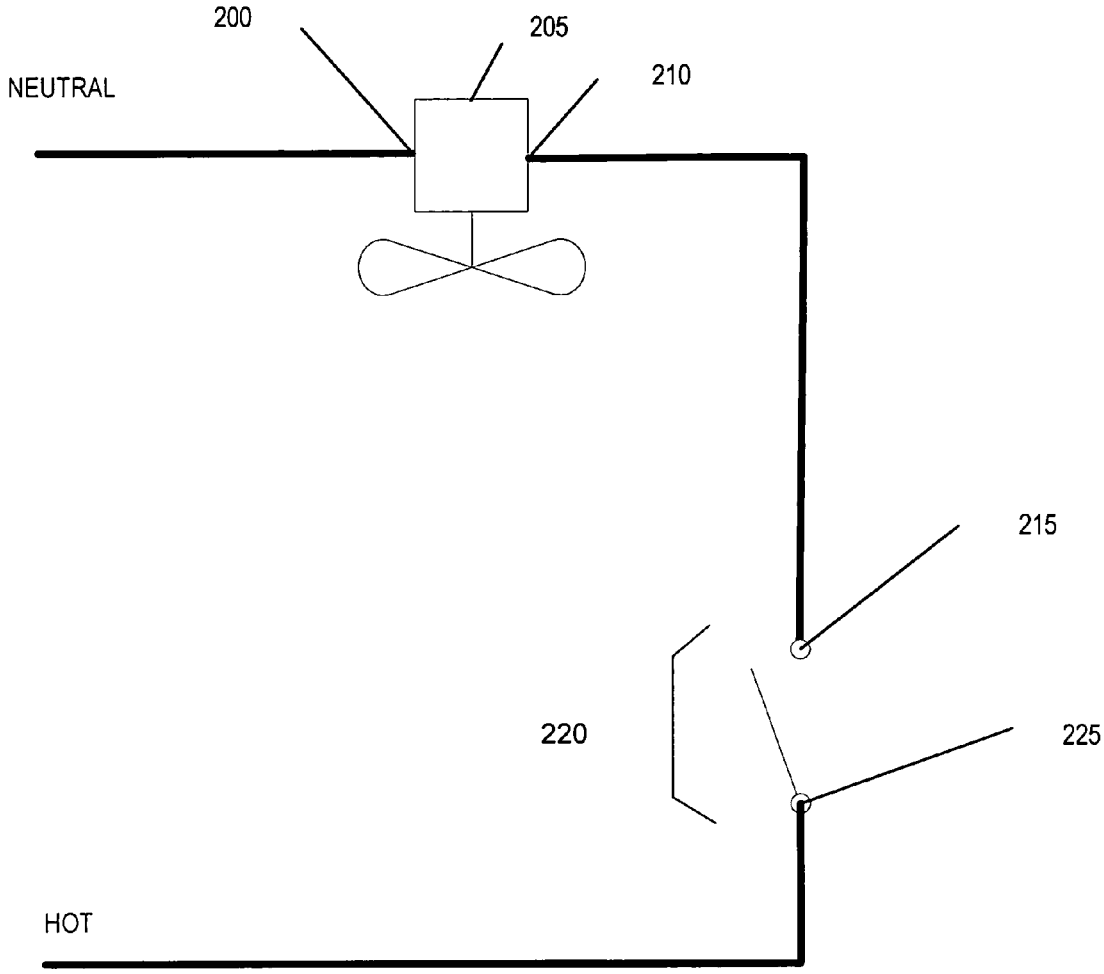
FIG. 3 is a schematic representation of a circuit for a bathroom fan.

FIG. 3 shows a schematic of the wiring of a bathroom fan. A neutral wire from a building's electrical system can connect to a first node 200 of a fan motor 205. A second node 210 of the fan motor 205 can connect to a first node 215 of a wall switch 220. A second node 225 of the wall switch 220 can be connected to a hot wire of the building's electrical system. Electrically closing the wall switch 220 completes the circuit and supplies power to the fan motor 205. This causes the fan to draw air from the bathroom and exhaust the air through the fan's duct 180.

In some embodiments of an IAQ system, one or more controllers operate the system. The controllers can be incorporated into the fans, the switches, or can stand alone. In addition, each controller can control a single fan or multiple fans.

Figure 4:
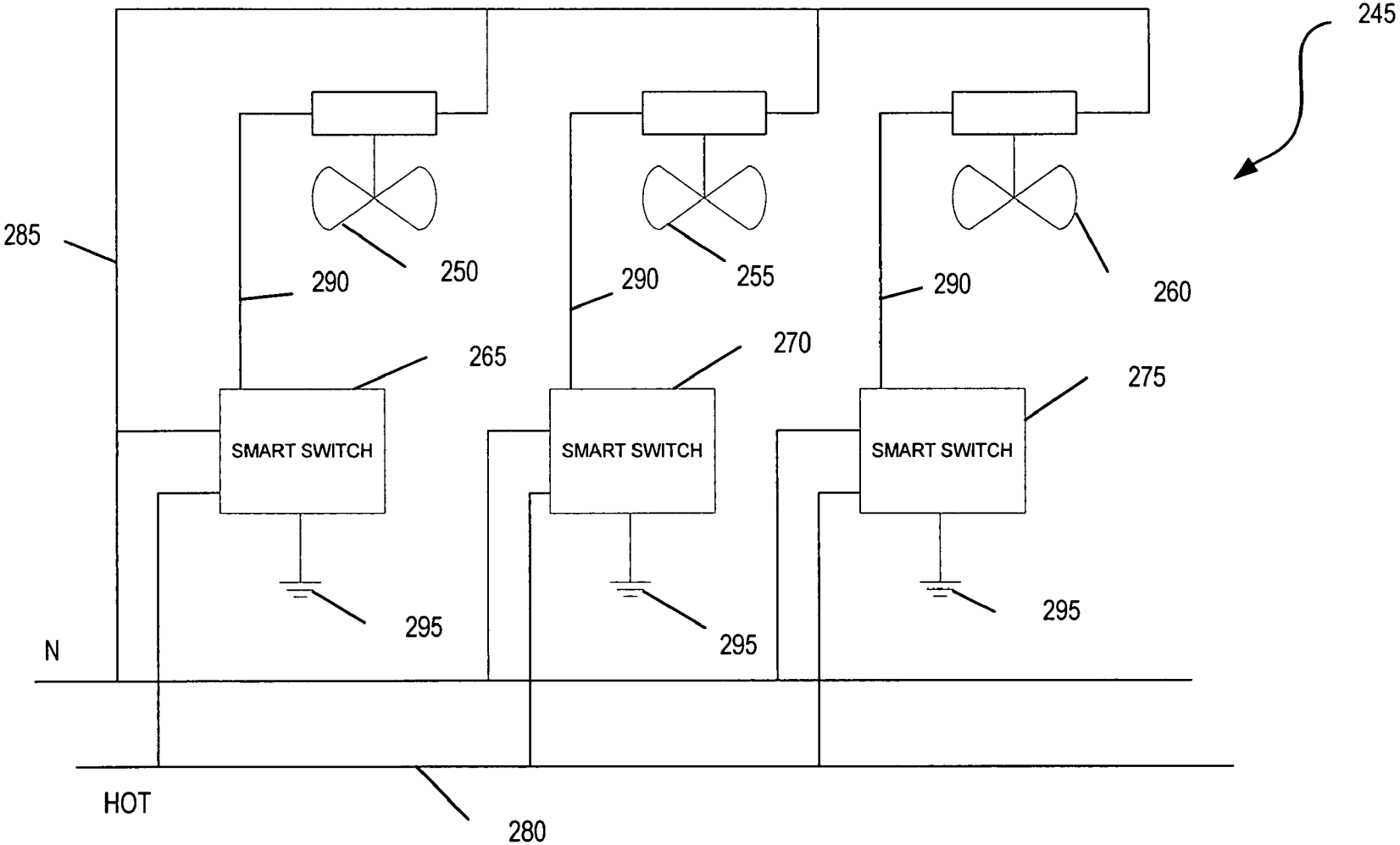
FIG. 4 is a schematic representation of an indoor air quality system including a plurality of smart switches to control a plurality of bathroom fans.

In one embodiment of the invention, each fan is controlled by a controller incorporated in a smart switch (e.g., Model INSTEON SwitchLinc V2 Relay, manufactured by Smarthome, Inc.). FIG. 4 shows a schematic illustration of an embodiment of an IAQ system 245 utilizing three bathroom fans for exhaust ventilation, a first fan 250, a second fan 255, and a third fan 260. Each fan can have an exhaust rating that is the same as or different than the other fans in the system. The first fan 250 is controlled by a first smart switch 265, the second fan 255 is controlled by a second smart switch 270, and the third fan 260 is controlled by a third smart switch 275. In some embodiments, one of the smart switches operates as a master controller for the IAQ system 245. The other smart switches operate as slave controllers. In the illustrated embodiment, the first smart switch 265 for the first fan 250 is the master controller. The master controller receives operating information from the slave controllers indicating when their respective fans are energized. The master controller uses this information to determine when each of the fans will need to energize to meet the desired ventilation rate $V_{MOVE}$. When the master controller determines that a fan needs to be energized, the master controller informs the associated slave controller to automatically energize its fan. The slave controllers monitor the IAQ system 245, and, in the event of a failure of the master controller, one of the slave controllers can assume the role of master controller.

As FIG. 4 shows, each smart switch 265, 270, and 275 is connected to a hot power line 280 and a neutral power line 285 of a building's electrical system. In addition, each fan 250, 255, and 260 is connected to the neutral power line 285. A load line 290 connects each smart switch 265, 270, and 275 to its respective fan 250, 255, and 260. The smart switches 265, 270, and 275 are also connected to earth ground 295. When a smart switch determines that a fan should be energized, the smart switch internally connects the hot power line 280 to the load line 290, providing power to the fan and energizing the fan.

Figure 5:
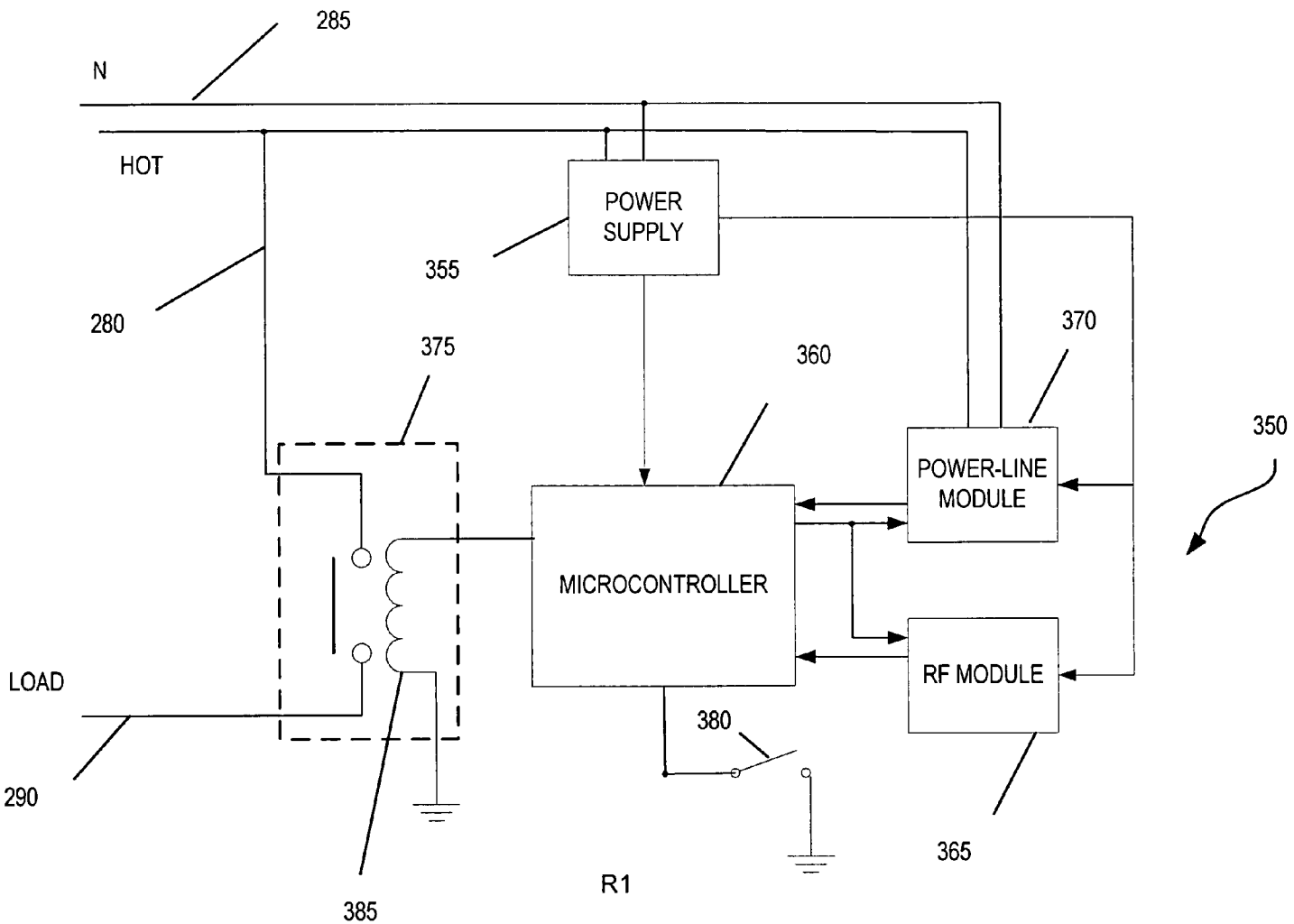
FIGS. 5 and 5A are schematics of exemplary embodiments of a smart switch.

An embodiment of a smart switch 350 is shown in schematic form in FIG. 5. The smart switch 350 includes a power supply module 355, a microcontroller 360, a radio frequency ("RF") transmitter and receiver module 365, a power-line transmitter and receiver module 370, a normally open relay 375, and a normally open switch 380. As used herein, the term "microcontroller" refers to one or more microcomputers, processors, application-specific integrated circuits, or any other suitable programmable circuit or combination of circuits.

The hot power line 280 and the neutral power line 285 of a building's electrical system are connected to the power source module 355. The power source module 355 converts the electric signal between the hot power line 280 and the neutral power line 285 to a low voltage direct current signal, +Vs (e.g., +5VDC), for use by the integrated circuits of the smart switch 350.

The RF transmitter and receiver module 365 receives digital signals from the microcontroller 360 and converts the digital signals to RF signals. The RF signals are then transmitted wirelessly to be received by other smart switches in the IAQ system. The RF transmitter and receiver module 365 also receives RF signals (e.g., from other smart switches in the IAQ system or a programming module) and converts the RF signals to digital signals. The digital signals are then provided to the microcontroller 360.

Similarly, the power-line transmitter and receiver module 370 receives digital signals from the microcontroller 360 and converts the digital signals to a modulated signal that is carried on the power lines and received by other smart switches in the IAQ system 245. The power-line transmitter and receiver module 370 also receives modulated signals carried on the power lines (e.g., from other smart switches in the IAQ system 245 or a programming module) and converts the modulated signals to digital signals. The digital signals are then provided to the microcontroller 360.

Both the RF transmitter and receiver module 365 and the power-line transmitter and receiver module 370 can send and receive the same messages. Transmissions sent by the microcontroller 360 are provided to both the RF transmitter and receiver module 365 and the power-line transmitter and receiver module 370 for transmission. Messages received by the RF transmitter and receiver module 365 and the power-line transmitter and receiver module 370 are provided to the microcontroller 360, which compares the messages to check for reception errors. This dual mode communication scheme can provide highly reliable communications. In other embodiments, a single mode communication scheme (e.g., RF or power-line communications only) may be employed.

In the embodiment shown in FIG. 5, the microcontroller 360 is connected to a first end of a coil 385 of the normally open relay 375. The second end of the coil 385, of the normally open relay 375, is connected to ground. When the microcontroller 360 applies power to the coil 385, the normally open relay 375 closes, and the hot wire 280 from the building's electrical system is connected to the load lead 290 of the smart switch 350. In some embodiments, the load lead 290 is connected to a fan (as shown in FIG. 4), and connecting the hot wire 280 to the load lead 290 energizes the fan.

The microcontroller 360 is connected to the normally open switch 380. A second lead on the normally open switch 380 can be connected to ground. In this configuration, the input of the microcontroller 360 is high when the normally open switch 380 is open and low when the normally open switch 380 is closed. In some embodiments, the microcontroller 360 can detect that the normally open switch 380 has been closed by a user and can then apply power to the coil 385 of the normally open relay 375, causing the normally open contacts to close. This connects the hot wire 280 to the load lead 290 and causes the fan to energize. When the normally open switch 380 is opened by a user, the input to the microcontroller 360 goes high. The microcontroller 360 detects this high level at its input and removes power from the coil 385 of the normally open relay 375. This opens the normally open contacts, disconnecting the hot line 285 from the load lead 290, and de-energizing the fan.

Figure 5A:
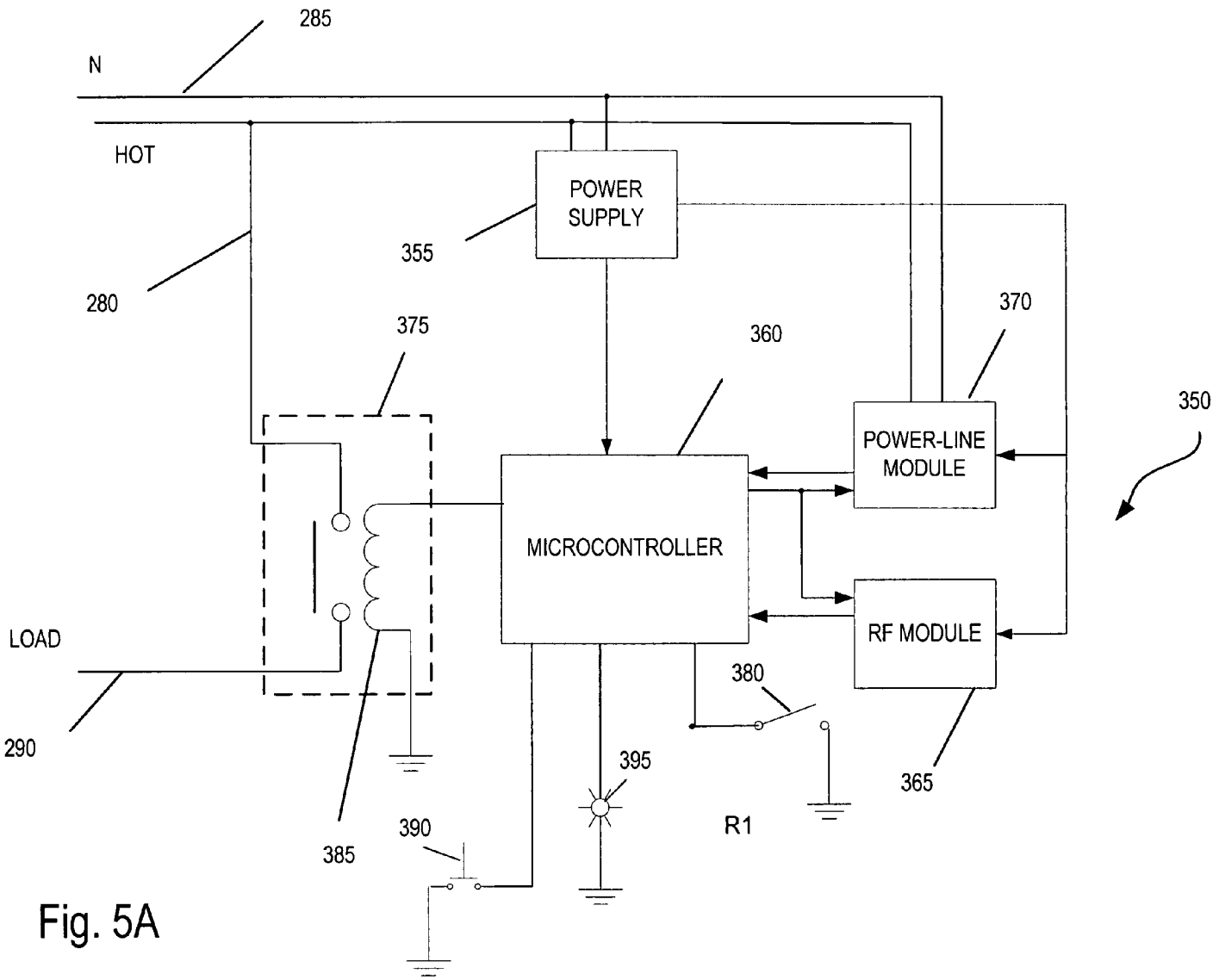

FIG. 5A shows a schematic of an embodiment of a smart switch with the addition of a programming button 390 and a programming indicator 395. The programming button 390 can be a normally open switch which when pressed connects a pin of the microcontroller 360 to ground. The programming indicator 395 can be a light emitting diode (LED) which is connected to the microcontroller 360. The microcontroller 360 lights the LED by applying a high signal to the programming indicator 395.

In some embodiments, the smart switches are programmed after being installed in a building. Each smart switch can be preprogrammed with a unique address, and in embodiments using 16-bit addresses, there can be over 17,000,000 unique addresses available for the smart switches.

Figure 6:
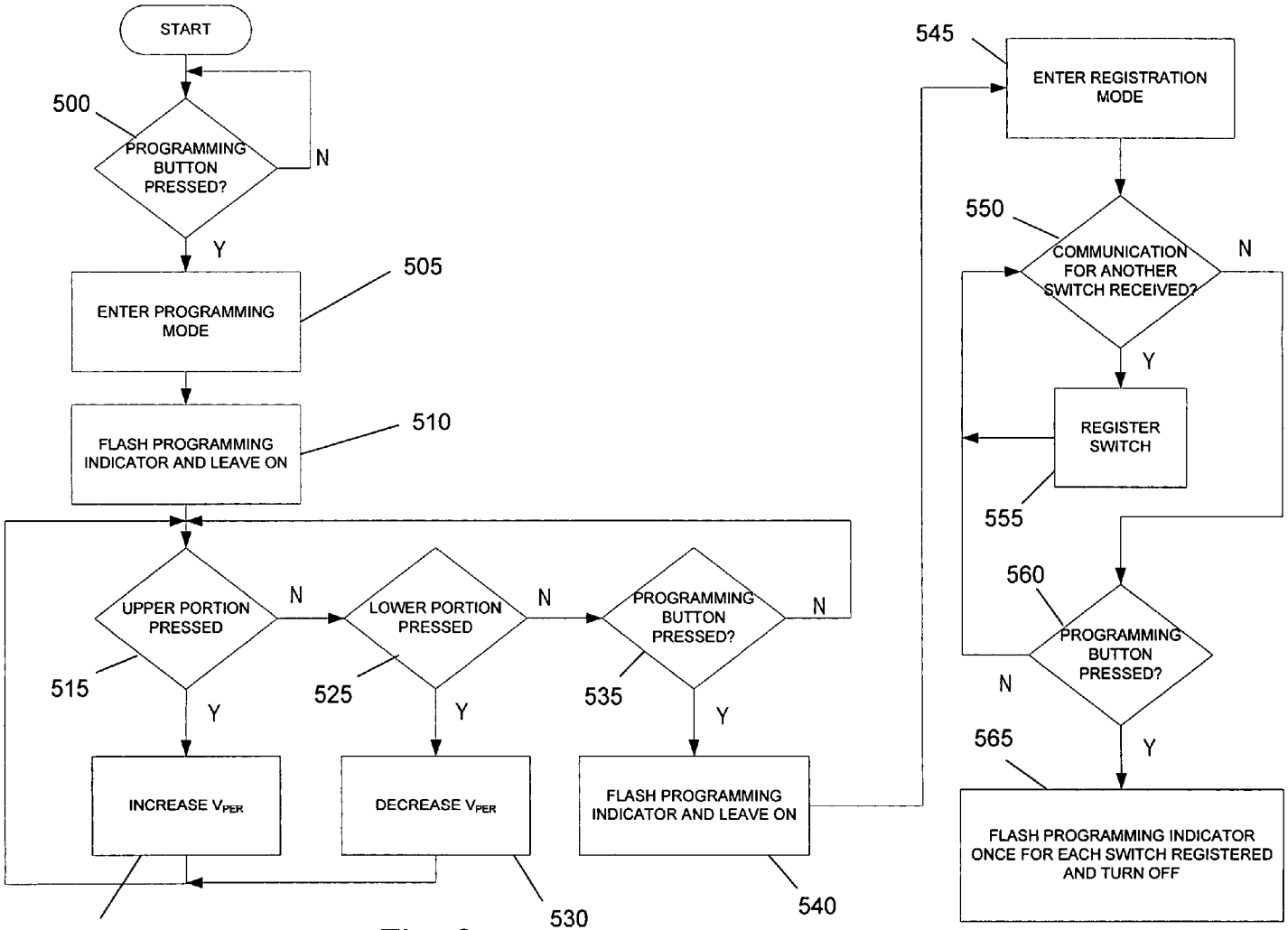
FIG. 6 is a flow chart of an embodiment of a process for programming a master smart switch.

FIG. 6 shows a flow chart of a process for programming the smart switches of an IAQ system for a building according to an embodiment of the invention. The programming of the smart switches begins by a user pressing the programming button 390 on a smart switch that the user designates as a master switch. The microcontroller 360 can detect (step 500) that the programming button 390 has been pressed. When the microcontroller 360 detects that the programming button 390 has been pressed, the microcontroller 360 enters (step 505) a programming mode and lights the programming indicator 395. In some embodiments, the microcontroller 360 can flash (step 510) the programming indicator 395 a predetermined number of times (e.g., once) to indicate that the smart switch is entering the programming mode.

In some embodiments, the smart switch is preprogrammed with several (e.g., ten) preset $V_{PER}$ ranges. Once the programming indicator 395 is lit, and the smart switch is in the programming mode, the user can select the $V_{PER}$ range appropriate for the building. In some embodiments, $V_{PER}$ values can range from 5,500 CF (e.g., for a one bedroom, 1,500 $ft^2$ residence) to 22,000 CF (e.g., for a six bedroom, 6,000 $ft^2$ residence). In some embodiments, the smart switch includes a switch which allows both up and down selections. The user can press an upper portion of the switch to increase the $V_{PER}$ range or a lower portion of the switch to decrease the $V_{PER}$ range. The microcontroller 360 checks (step 515) if the upper portion of the switch has been pressed. If the upper portion of the switch is pressed, the microcontroller 360 increases (step 520) the $V_{PER}$ range by one. The microcontroller 360 also checks (step 525) if the lower portion of the switch has been pressed. If the lower portion of the switch is pressed, the microcontroller 360 decreases (step 530) the $V_{PER}$ range by one. Once the user has selected the appropriate $V_{PER}$, the user can again press the programming button 390. In some embodiments, when the microcontroller 360 detects (step 535) that the programming button 390 has been pressed, the microcontroller 360 can flash (step 540) the programming indicator 395 a quantity of times reflective of the chosen $V_{PER}$. The microcontroller 360 can then leave the programming indicator 395 lit and enter (step 545) a registration mode.

In some embodiments, the smart switch assumes that all of the fans in the IAQ system have a default exhaust rate (e.g., 100 CFM). If the fans in the IAQ system have a different exhaust rate than the default, the $V_{PER}$ range can be adjusted to compensate for the difference. The user totals the exhaust rate for all of the fans in the IAQ system and divides this total by the number of fans in the IAQ system multiplied by 100. This provides a ratio of the exhaust rate assumed by the $V_{PER}$ range and the actual exhaust rate. The user can then divide the $V_{PER}$ calculated for a building by the calculated ratio. This adjusted $V_{PER}$ can then be used for setting the $V_{PER}$ range, and the IAQ system can achieve the actual $V_{PER}$ desired.

Referring again to FIG. 6, with the smart switch in the registration mode, the user turns each of the other smart switches in the IAQ system on and off one time. Each smart switch communicates, via its RF transmitter and receiver module 365 and its power-line transmitter and receiver module 370, its address and operational status (e.g., "on" or "off"). The master smart switch monitors (step 550) these communications and registers (step 555) each smart switch in the IAQ system when it receives a communication from that switch.

After all of the smart switches in the IAQ system have been registered, the user can press the programming button 390 on the master switch again. In some embodiments, once the microcontroller 360 detects (step 560) that the programming button 390 has been pressed, the microcontroller 360 flashes (step 565) the programming indicator 395 (e.g., once for each smart switch registered) and then turns off the programming indicator 395. Programming of the IAQ system is then complete.

It can be necessary, in certain circumstances (e.g., errors in setting parameters or when changes occur in the IAQ system), to reset the master smart switch and remove its $V_{PER}$ range setting and smart switch registrations. In some embodiments, resetting the master switch can be accomplished by pressing the programming button 390 for an extended period (e.g., 10 seconds). The microcontroller 360 can monitor the programming button 390, and if the microcontroller 360 detects that the programming button 390 has been pressed for the extended period, the microcontroller 360 can reset the parameters stored in the smart switch to the factory defaults.

In some embodiments, a programming module (not shown) can be used to program an IAQ system. To program the IAQ system, the programmer is set to a read mode and links to the smart switches of the IAQ system via either RF or power-line means or both. For each fan in the IAQ system, a user manually energizes the fan, one fan at a time, by closing the normally open switch 380 of the smart switch for the fan. When a smart switch energizes a fan, the smart switch transmits, from its RF module and its power-line module, a communication specifying, for example, the address and operational status of the smart switch.

The programming module receives the communication from the smart switch and sends information to the smart switch including, for example, whether the smart switch should be a master or a slave; the exhaust rate, in CFM, of the fan associated with that smart switch; and the $V_{MOVE}$ and $T_{PER}$ of the IAQ system. In one embodiment, each smart switch in the IAQ system can monitor and store information transferred between the programming module and the other smart switches in the IAQ system.

The IAQ system can be configured by programming each of the smart switches in the system. In some embodiments, the master switch can be the last smart switch to be programmed. After programming, the master switch can interrogate the system to determine the configuration of the IAQ system. When the master switch interrogates the system, the slave switches can respond individually. Each slave switch can delay a unique time period (e.g., based on its address) such that two or more slave switches do not respond to the master switch's interrogation at the same time. In response to the master switch's interrogation, each slave switch can provide its address and the exhaust rate (in CFM) of the fan it controls.

In addition to the master switch, each slave switch can monitor the interrogations and save information about all or some of the smart switches in the system. Should the master switch fail, each slave switch can have the data necessary to assume the responsibilities of the master switch.

The master switch can periodically interrogate the system to ensure that no existing slave switches have failed and/or that no new slave switches have been added. If a slave switch does not respond when interrogated, the master switch adjusts its operation in an attempt to meet the $V_{PER}$ with the remaining slave switches and their associated fans.

The slave switches can also monitor the system for the master switch's interrogation. If the master switch does not interrogate the system for a predetermined period, the slave switches can determine that the master switch has failed, and a designated slave switch can assume the master switch's role.

In other embodiments, the smart switches are programmed using dip switches, either alone or in combination with other means. In some embodiments of an IAQ system, the fans store their exhaust rating and the smart switches read the exhaust rating directly from the fans instead of receiving it through programming. In still other embodiments, the controllers are located in the fans. In such embodiments, the fans can assume some or all the functionality of the smart switches as explained herein, and the switches can function as standard normally open switches.

In some embodiments of an IAQ system, the smart switches can leave the fans energized for a predetermined period of time following a user manually turning the fans off.

In some larger buildings, power-line communication between smart switches can be inhibited when the electrical system of the building uses more than one phase of electricity. In such buildings, power-line communications of smart switches on one phase of electricity may be isolated from power-line communication of smart switches on a second phase of electricity. In some embodiments, a power-line communication coupler (e.g., model Hardwired SignaLinc™ Phase Coupler manufactured by Smarthome, Inc.) can be used to effectively couple the different phases of electricity for power-line communications, enabling smart switches on one phase of electricity to communicate with smart switches on another phase of electricity.

In addition, power levels of the RF transmitters in the smart switches may not be sufficient for a smart switch on one end of a building to reliably communicate with a smart switch on the opposite end of the building. In some embodiments, this situation can be resolved through the use of one or more RF repeaters. An RF repeater can receive messages from each of the smart switches and retransmit the messages received. The RF repeater can be located centrally in the building and enable the RF repeater to receive relatively weak signals from smart switches located at the ends of the building. The RF repeater then retransmits the messages at a relatively strong signal strength. This can ensure that messages from the smart switches are transmitted at a signal strength sufficient to be received by the other smart switches.

Generally, a bathroom fan removes indoor air from the bathroom and, to a lesser extent, from surrounding rooms. In some instances, it is desirable to circulate air throughout the entire building to ensure that the indoor air in the building is evenly exchanged. In some embodiments, a furnace blower can be energized automatically, whenever a fan of an IAQ system is energized, to disperse the indoor air throughout the building. Other embodiments energize the furnace blower when a fan of an IAQ system is energized automatically (or at some time prior to the fan being automatically energized) and do not energize the furnace blower when a fan of the IAQ system is energized manually.

Figure 7A:
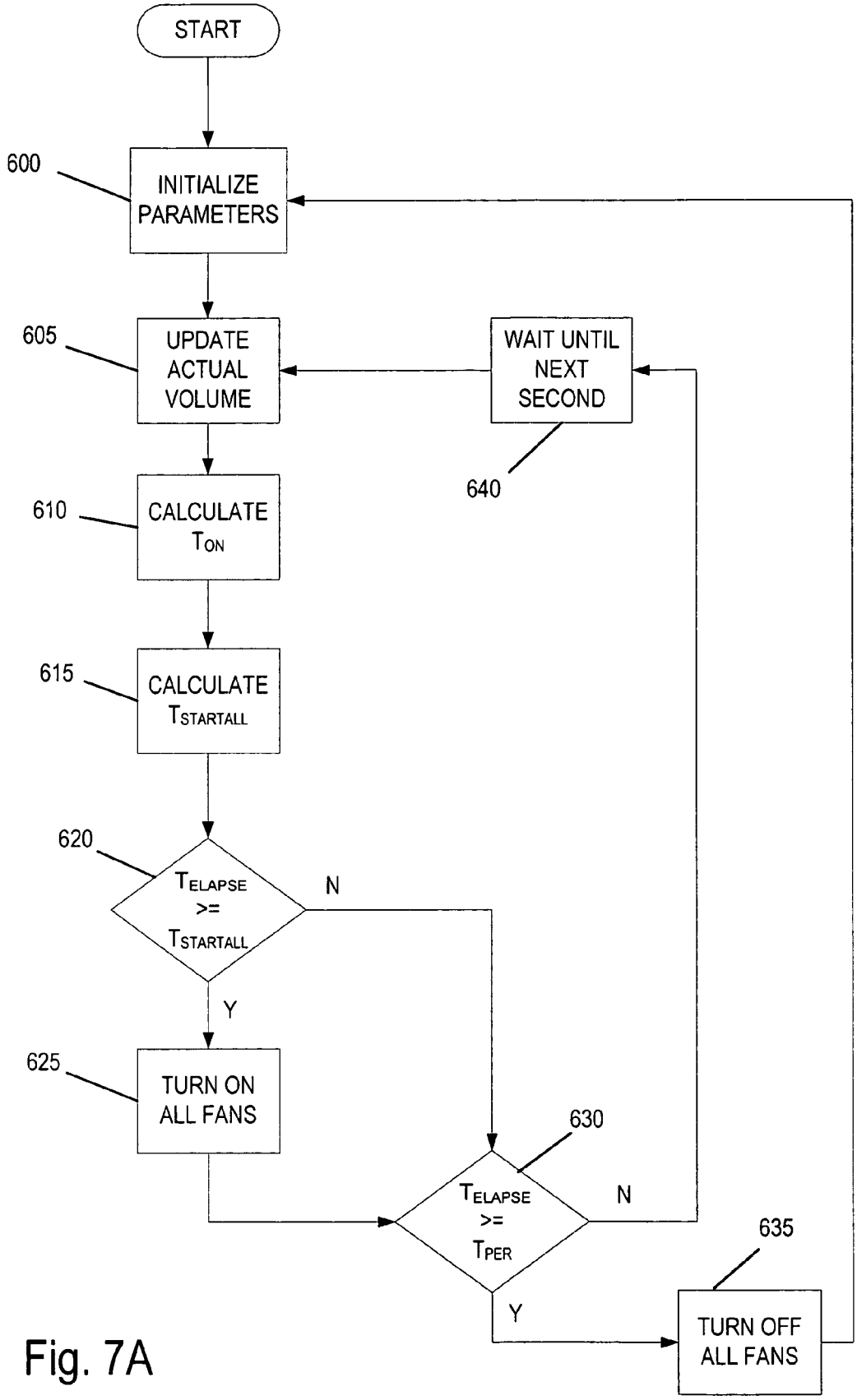
FIG. 7A is a flow chart of an embodiment of a process for an indoor air quality system incorporating exhaust ventilation and operating a plurality of fans concurrently.
Figure 7B:
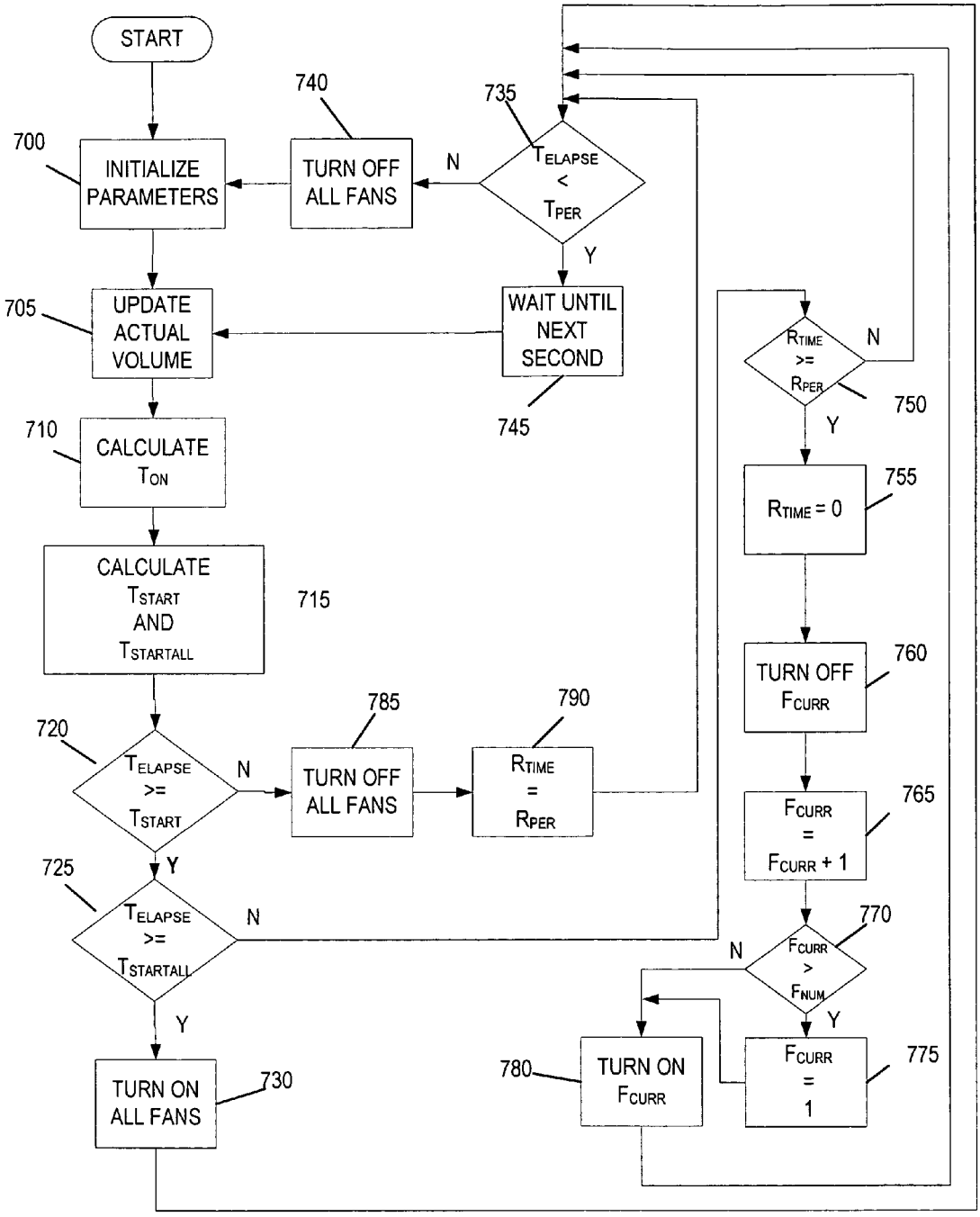
FIG. 7B is a flow chart of an embodiment of a process for an indoor air quality system incorporating exhaust ventilation and operating a plurality of fans sequentially.

FIGS. 7A and 7B are flow charts of processes describing the operation of an IAQ system according to embodiments of the invention. In a first embodiment as expressed by FIG. 7A, all the bathroom fans can be energized simultaneously at the end of the time period $T_{PER}$ to meet the desired volume of air to be exchanged in the time period $V_{PER}$. In a second embodiment as represented by FIG. 7B, each bathroom fan can be energized individually in succession at the end of the $T_{PER}$ to meet the desired $V_{PER}$. Operating each bathroom fan individually in succession can be desirable in buildings where leak points 120 are insufficient to replace the volume of air exhausted by all of the fans when the fans are run simultaneously. In these cases, back drafting can occur at vents within the building (e.g., exhaust vents for gas hot water heaters), creating the possibility of increasing levels of carbon monoxide in the residence.

During operation of the IAQ system, the fans can be energized manually by a user closing the normally open switch 380 (see FIG. 5). This reduces the time the fans need to be run at the end of the $T_{PER}$ to meet the desired $V_{PER}$. As used herein, automatic operation of fans includes energizing of fans by the microcontroller 360 to meet the desired $V_{PER}$, and manual operation of fans includes energizing of fans by a user closing the normally open switch 380.

Turning to the embodiment of FIG. 7A, the microcontroller 360 can begin by initializing (step 600) a number of parameters. As an example, the parameters that can be initialized include:

$V_{MOVE}$=(0.01×2000)+(7.5×(3+1))=50 CFM or 0.8333 cubic feet per second ("CFS")

$F_{NUM}$=2 (one fan in each bathroom)

$F_{1CAP}$=50 CFM (0.8333 CFS)

$F_{2CAP}$=75 CFM (1.25 CFS)

$F_{CAP}=F_{1CAP}+F_{2CAP}$=125 CFM (2.0833 CFS)

$T_{PER}$=3 hours or 10,800 seconds $T_{ELAPSE}$=0

$V_{PER}=V_{MOVE}\times T_{PER}$=0.8333 CFS×10,800 seconds=9,000 CF $V_{ACT}$=0

Where:

$V_{MOVE}$ is the rate at which air is to be exchanged in CFM;

$F_{NUM}$ is the number of fans in an IAQ system;

$F_{1CAP}$ and $F_{2CAP}$ are the rated exhaust capacities of fan #1 and fan #2 respectively;

$F_{CAP}$ is the exhaust capacity of the entire IAQ system;

$T_{PER}$ is the time period in which the air exchange is to take place;

$T_{ELAPSE}$ is the amount of time elapsed in the present $T_{PER}$;

$V_{PER}$ is the total volume of air to be exchanged during $T_{PER}$; and $V_{ACT}$ is the volume of air actually exchanged during $T_{ELAPSE}$.

In this embodiment, the process executes once each second, and all time variables are adjusted to be in seconds. Other embodiments can execute at faster or slower rates.

Following initialization, the microcontroller 360 can update (step 605) a total volume of air actually exchanged from the beginning of the present time period until the present ($V_{ACT}$). This can be calculated by checking each fan in the system to determine if it is running and for each fan that is running, adding the volume of air that can be moved by that fan each second to $V_{ACT}$. For example, fan #1 ($F_1$) is checked to see if it is running (either automatically or manually). If $F_1$ is running, then the volume of air it moves each second, which is equal to its exhaust rate ($F_{1CAP}$) in CFS, is added to $V_{ACT}$. $V_{ACT}$ is updated for each fan in the IAQ system.

Once the actual volume of air exchanged, $V_{ACT}$, has been updated, a length of time that all of the fans must be turned on to meet the ASHRAE standard ($T_{ON}$) can be determined (step 610). $T_{ON}$ is calculated using the following formula:

$$T_{ON}=(V_{PER}-V_{ACT})/F_{CAP}$$

In this example, the volume of air to be exchanged per time period is 9,000 CF. At the beginning of the time period, the actual volume exchanged is 0 CF. The volume capacity of all of the fans combined is 2.0833 CFS. Plugging these numbers into the formula provides the result:

$$T_{ON}=(9{,}000\text{ CF}-0\text{ CF})/2.0833\text{ CFS}=4{,}320\text{ seconds}$$

Therefore, if none of the fans were run manually during the time period, all of the fans would need to be energized for 4,320 seconds to reach the 9,000 CF desired. The microcontroller 360 then determines (step 615) the latest time that the fans can be started ($T_{STARTALL}$) to achieve the goal of 9,000 CF. This is calculated using:

$$T_{STARTALL}=T_{PER}-T_{ON}$$

Again substituting the 10,800 seconds for the time period and the on time of 4,320 seconds gives:

$$T_{STARTALL}=10{,}800-4{,}320=6{,}480\text{ seconds}$$

Therefore, to move 9,000 CF of air, all of the fans can start after 6,480 seconds (108 minutes) if none of the fans has been run in manual mode prior to that time. When one or more fans have been run in manual mode, the value $V_{ACT}$ increases, which in turn reduces $T_{ON}$ and delays $T_{STARTALL}$. Because some of the 9,000 CF that must be moved was moved manually, the amount of time all the fans must be automatically energized to meet the standard is reduced.

Next, $T_{STARTALL}$ is compared (step 620) to the elapsed time in the period ($T_{ELAPSE}$). If $T_{ELAPSE}$ is greater than or equal to $T_{STARTALL}$, the microcontroller 360 energizes (step 625) all of the fans in the IAQ system.

After energizing the fans (step 625) or if $T_{ELAPSE}$ was less than $T_{STARTALL}$ (step 620), the microcontroller 360 can check (step 630) if $T_{ELAPSE}$ is greater than or equal to $T_{PER}$. If $T_{ELAPSE}$ is greater than or equal to $T_{PER}$, the present time period is over and the microcontroller 360 can turn off (step 635) all the fans not being run manually, initialize (step 600) the IAQ system parameters, and start the next time period. If the present time period is not complete, the microcontroller 360 can wait (step 640) until the start of the next second, then update (step 605) the actual volume, and continue processing.

Turning to FIG. 7B, in this embodiment the microcontroller 360 begins by initializing (step 700) a number of parameters. The parameters can be the same as for step 600 of FIG. 7A with the addition of:

$$R_{PER}=5\text{ minutes}$$

$$R_{TIME}=R_{PER}$$

$$F_{CURR}=F_{NUM}$$

Where:

$R_{PER}$ is the period of time each fan will be run automatically before switching to the next fan;

$R_{TIME}$ is a timer value indicating how long the fan presently running automatically has been running; and $F_{CURR}$ is the number of the fan being run automatically (during initialization $F_{CURR}$ is set such that fan #1 will be the first fan run automatically as will be shown below).

In this embodiment, the process executes once each second and all time variables are adjusted to be in seconds. Other embodiments can execute at faster or slower rates.

Next, the microcontroller 360 updates (step 705) a total volume of air actually exchanged from the beginning of the present time period until the present ($V_{ACT}$). This can be calculated by checking each fan in the IAQ system to determine if it is running and for each fan that is running, adding the volume of air that can be moved by that fan each second to $V_{ACT}$. For example, fan #1 ($F_1$) is checked to see if it is running (either automatically or manually). If $F_1$ is running, then the volume of air it moves each second, which is equal to its exhaust rate ($F_{1CAP}$) in CFS, is added to $V_{ACT}$. $V_{ACT}$ is updated for each fan in the system.

Once the actual volume of air exchanged, $V_{ACT}$, has been updated, a length of time that all of the fans must be turned on to achieve the ASHRAE standard ($T_{ON}$) can be determined (step 710). $T_{ON}$ can be calculated using the following formula:

$$T_{ON}=(V_{PER}-V_{ACT})/F_{CAP}$$

In this example, the volume of air to be exchanged per time period is 9,000 CF. At the beginning of the time period, the actual volume exchanged is 0 CF. The volume capacity of all of the fans combined is 2.0833 CFS. Plugging these numbers into the formula above provides the result:

$$T_{ON}=(9{,}000\text{ CF}-0\text{ CF})/2.0833\text{ CFS}=4{,}320\text{ seconds}$$

Therefore, if none of the fans were run manually during the time period, all of the fans would need to be energized for 4,320 seconds to reach the 9,000 CF desired. The microcontroller 360 then determines (step 715) the latest time that the fans can be started ($T_{STARTALL}$) to achieve the goal of 9,000 CF. This is calculated using:

$$T_{STARTALL}=T_{PER}-T_{ON}$$

Again substituting the 10,800 seconds for the time period and the on time of 4,320 seconds gives:

$$T_{STARTALL}=10{,}800-4{,}320=6{,}480\text{ seconds}$$

In this embodiment, the fans can be run individually in succession to achieve the desired volume of air to exchange in $T_{PER}$. It was previously determined that each fan needs to run for 4,320 seconds to reach the 9,000 CF. Since the fans are not energized at the same time in this embodiment, a start time ($T_{START}$) is calculated using the formula:

$$T_{START}=T_{PER}-(T_{ON}\times F_{NUM})$$

Again substituting the total of 10,800 seconds for the time period, the on time of 4,320 seconds for each fan, and the number of fans in the IAQ system (two in this example) gives:

$$T_{START}=10{,}800-(4{,}320\times 2)=2{,}160\text{ seconds}$$

Therefore, to move 9,000 CF of air, automatic operation of the fans starts after 2,160 seconds (36 minutes), if none of the fans has been run in manual mode prior to that time. When one or more fans have been run in manual mode, the value $V_{ACT}$ increases, which in turn reduces $T_{ON}$ and delays $T_{START}$. Because some of the 9,000 CF that must be exchanged was moved manually, the amount of time all the fans must be energized to meet the standard is reduced.

Next, $T_{START}$ is compared (step 720) to the elapsed time in the period ($T_{ELAPSE}$). If $T_{ELAPSE}$ is greater than or equal to $T_{START}$, the microcontroller 360 compares (step 725) $T_{STARTALL}$ to the elapsed time in the period ($T_{ELAPSE}$). If $T_{ELAPSE}$ is greater than or equal to $T_{STARTALL}$, the microcontroller 360 energizes (step 730) all of the fans.

After turning on the fans (step 730), the microcontroller 360 checks (step 735) if $T_{ELAPSE}$ is greater than or equal to $T_{PER}$. If $T_{ELAPSE}$ is greater than or equal to $T_{PER}$, the period is over and the microcontroller 360 can turn off (step 740) all the fans not being run manually, as well as initialize (step 700) the IAQ system parameters and start the next period. If the period is not complete, the microcontroller 360 can wait (step 745) until the start of the next second, then update (step 705) the actual volume, and continue processing.

If, at step 725, $T_{ELAPSE}$ is less than $T_{STARTALL}$, the microcontroller 360 compares (step 750) the run time ($R_{TIME}$) to the run period ($R_{PER}$). $R_{TIME}$ is a timer that continuously counts up. The $R_{PER}$ is the amount of time an individual fan will run before switching to the next fan. This enables the fans to cycle on and off for relatively short periods rather than running each fan for the full $T_{ON}$ (4,320 seconds in this example). This can result in a more even exchange of air throughout the building. In this example, $R_{PER}$ can be set to five minutes.

The first time the comparison of step 750 is made, $R_{TIME}$ can be greater than or equal to $R_{PER}$. $R_{TIME}$ is then set (step 755) to zero. The fan currently running in automatic mode ($F_{CURR}$) is turned off (step 760). Next, $F_{CURR}$ is incremented (step 765) by one. If $F_{CURR}$ is greater than $F_{NUM}$ (step 770), $F_{CURR}$ is set to one (step 775). Next, $F_{CURR}$ is energized (step 780) and the microcontroller 360 checks (step 735) if $T_{ELAPSE}$ is greater than or equal to $T_{PER}$. If $T_{ELAPSE}$ is greater than or equal to $T_{PER}$, the present time period is over and the microcontroller 360 can turn off (step 740) all the fans not being run manually and initialize (step 700) the IAQ system parameters and start the next time period. If the present time period is not complete, the microcontroller 360 can wait (step 745) until the start of the next second, then update (step 705) the actual volume, and continue processing.

If, at step 720, $T_{ELAPSE}$ is not greater than or equal to $T_{START}$, the microcontroller 360 turns off (step 785) all fans being run automatically and sets (step 790) the run time $R_{TIME}$ equal to the run period $R_{PER}$.

In some embodiments of the IAQ system, the fans are automatically energized as late in $T_{PER}$ as possible to meet the ASHRAE standard. This can result in higher energy efficiency as any manual operation of the fans will be factored into the calculation for the amount of time the fans are run and will prevent the fans from running for an additional period of time, exceeding the requirements of the ASHRAE standard. Other embodiments can automatically energize the fans for periods throughout $T_{PER}$ and can achieve more consistent air exchange throughout $T_{PER}$. Still other embodiments can monitor environmental conditions (e.g., humidity, carbon monoxide, etc.) and can automatically energize the fans when, for example, the monitored condition(s) exceed a threshold or drop below a threshold. The fan or fans that are energized can be local to the monitored condition and/or can include all or some other fans within the building.

In some embodiments, the IAQ system can link to other systems in the building (e.g., environmental, computer, phone). For example, the IAQ system can link to a make-up air system which draws outdoor air into a building. In some embodiments, the make-up air is distributed through the building via the building's HVAC ducting. The IAQ system can monitor all of the exhaust fans (e.g., bathroom fans and range hoods) in the building and can communicate to the make-up air system the rate at which air is being exhausted throughout the whole building. The make-up air system can then draw outdoor air into the building at a rate sufficient to replace the air being exhausted. Such embodiments can reduce backdraft issues in buildings.

Other embodiments of the IAQ system can sense the presence of people in the building (e.g., with motion or heat sensors) and can adjust system operation accordingly. For example, if there are no people in the building, the IAQ system can reduce the number of air exchanges that will be performed. Reducing the number of air exchanges rather than eliminating the air exchanges may be desirable. Conversely, if the IAQ system detects more (or fewer) people in the building than the number that was used in calculating $V_{MOVE}$ (i.e., the number of people detected does not equal the number of bedrooms plus one for a residence), the IAQ system can recalculate $V_{MOVE}$ based on the actual number of people detected and adjust system operation up or down accordingly.

In some embodiments, the IAQ system can operate in a set back mode. In one embodiment of a set back mode, the IAQ system can reduce the number of air exchanges during periods when the building is unoccupied and resume normal operation when the building is occupied. In some embodiments, the IAQ system can automatically energize the fans for a predetermined period prior to the expected return of people to the building after a period in which the building was unoccupied.

In some embodiments, the IAQ system can operate based on a set of zones. For example, a residence may have bedrooms upstairs and living quarters downstairs. During daytime operation, the IAQ system can automatically energize fans located downstairs to exchange the indoor air where people are more likely to be present and can automatically energize fans located upstairs in the evening and nighttime when people are more likely to be present in the bedrooms.

In some embodiments, the IAQ system can keep a historical record of its operation. The historical data can be provided to another device (e.g., a computer) for display and/or analysis.

Various features and advantages of the invention are set forth in the following claims.

What is claimed is:

1. A method of exchanging air in a building, the method comprising:

providing a plurality of exhaust fans being at least partially disposed within the building;

operatively coupling at least two controllers to each of at least two of the plurality of exhaust fans;

establishing a desired volume of air to be exhausted from the building in a time period;

determining a volume of air actually exhausted using at least two controllers;

calculating a remaining volume of air to be exhausted in the time period using at least two controllers, wherein calculating the remaining volume of air to be exhausted in the time period includes subtracting the volume of air actually exhausted by the plurality of exhaust fans from the desired volume of air to be exhausted from the building;

determining a time at which to begin exhausting the remaining volume of air using input from at least a portion of the plurality of controllers; and activating at least a portion of the plurality of exhaust fans to exhaust the remaining volume of air during the time period, based at least in part on the determined time.

2. The method of claim 1 and further comprising monitoring the operation of the plurality of fans, wherein the tracked volume of air at least in part comprises air exhausted by the fans.

3. The method of claim 2 and further comprising energizing the fans when the length of time needed to exhaust the remaining volume of air equals the time period less an amount of time elapsed during the time period.

4. The method of claim 1 wherein exhausting the remaining volume of air includes energizing a plurality of fans sequentially, one fan at a time, for a run period.

5. The method of claim 2 and further comprising determining an exhaust rate for each of the plurality of fans.

* * * * *